US011485153B2

(12) United States Patent
Nakamura et al.

(10) Patent No.: US 11,485,153 B2
(45) Date of Patent: Nov. 1, 2022

(54) CUTTING DEVICE AND PRINTER

(71) Applicant: BROTHER KOGYO KABUSHIKI KAISHA, Nagoya (JP)

(72) Inventors: Yuya Nakamura, Toyoake (JP); Masashi Iwamoto, Nagoya (JP); Ryuichi Kanda, Nagoya (JP); Masashi Tanizaki, Kuwana (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 93 days.

(21) Appl. No.: 17/162,260

(22) Filed: Jan. 29, 2021

(65) Prior Publication Data

US 2021/0237489 A1 Aug. 5, 2021

(30) Foreign Application Priority Data

Jan. 30, 2020 (JP) ..... JP2020-013321

(51) Int. Cl.
*B41J 11/70* (2006.01)
*B41J 3/407* (2006.01)
*B41J 2/32* (2006.01)

(52) U.S. Cl.
CPC ..... *B41J 11/703* (2013.01); *B41J 3/4075* (2013.01); *B41J 2/32* (2013.01)

(58) Field of Classification Search
CPC . B41J 3/4075; B41J 2/32; B41J 11/703; B41J 11/666; G03G 2215/00814
See application file for complete search history.

(56) References Cited

U.S. PATENT DOCUMENTS

2005/0061132 A1* 3/2005 Sodeyama ..... B41J 11/703 83/694
2015/0084262 A1 3/2015 Sago et al.
2017/0274680 A1* 9/2017 Kosuge ..... B26D 1/305
2018/0281221 A1* 10/2018 Sugimoto ..... B26D 1/30

FOREIGN PATENT DOCUMENTS

JP 2014-136301 A 7/2014
JP 2015-136908 A 7/2015

* cited by examiner

*Primary Examiner* — Kristal Feggins
(74) *Attorney, Agent, or Firm* — Kenealy Vaidya LLP

(57) ABSTRACT

A cutting device, having a full-cutting assembly, a half-cutting assembly, and a cam, is provided. The full-cutting assembly includes a first cutting blade and a facing part to cut a tape fully through in a direction of thickness of the tape by rotating a first arm about a first shaft. The half-cutting assembly includes a second cutting blade and a supporting base to cut the tape partly in the direction of thickness by rotating a second arm about a second shaft. The cam is rotatable bidirectionally about a third shaft and has a cam face, on which a first pressing part to press the first arm and a second pressing part to press the second arm are arranged. A distance between the cam face and the second arm is smaller than or equal to a distance between the cam face and the first arm.

10 Claims, 13 Drawing Sheets

CUTTING DEVICE AND PRINTER

CROSS REFERENCE TO RELATED APPLICATION

This application claims priority from Japanese Patent Application No. 2020-013321, filed on Jan. 30, 2020, the entire subject matter of which is incorporated herein by reference.

BACKGROUND

Technical Field

An aspect of the present disclosure is related to a cutting device and a printer.

Related Art

A printer with a cutting device for cutting a piece of tape off from a larger piece is known. The cutting device may have a half-cutting assembly, a full-cutting assembly, a cutter-driving motor, and a cam plate. The half-cutting assembly may have a supporting base and a cutting blade to perform a half-cutting action, in which some of laminated layers in the tape are cut and keep the other of the layers uncut. The full-cutting assembly may have a stationary blade and a movable blade to perform a full-cutting action, in which the laminated layers in the tape are all cut through. The cutter-driving motor may rotate in one direction and the other direction to cause the cam plate to rotate, for example, clockwise and counterclockwise. When the cam plate rotates clockwise, the cam plate may move a plate member coupled with the cutting blade to cause the cutting blade to be pressed against the supporting base while the tape intervenes between the cutting blade and the supporting base. The half-cutting assembly may thus perform the half-cutting action. When the cam plate rotates counterclockwise, the cam plate may move a plate member coupled with the movable blade to cause the movable blade to intersect with the stationary blade while the tape intervenes between the movable blade and the stationary blade. The full-cutting assembly may thus perform the full-cutting action.

SUMMARY

In the known cutting device, a distance between the cam plate and the plate member coupled with the cutting blade in the half-cutting assembly may be greater than a distance between the cam plate and the plate member coupled with the movable blade in the full-cutting assembly, in a direction, along which the cam plate faces the plate members. In this regard, a transmission rate of a driving force from the cutter-driving motor through the cam plate to the plate member for the cutting blade in the half-cutting assembly is smaller than a transmission rate of the driving force from the cutter-driving motor through the cam plate to the plate member for the movable blade in the full-cutting assembly. Therefore, in order to perform the half-cutting action reliably, it may be necessary to increase a driving load on the cam plate for the half-cutting action. In other words, the cam plate may need to bear the increased driving load when the half-cutting action is performed.

The present disclosure is advantageous in that a cutting device and a printer, which may restrain the driving load on the cam from increasing when a half-cutting assembly performs a half-cutting action, are provided.

According to an aspect of the present disclosure, a cutting device, having a full-cutting assembly, a half-cutting assembly, and a cam, is provided. The full-cutting assembly includes a first cutting blade and a facing part that face each other in a first direction. The first cutting blade and the facing part extend in a second direction, which intersects with the first direction. The first cutting blade is coupled with a first arm. The first arm is rotatable about a first shaft extending in a third direction, which intersects with the first direction and the second direction. The full-cutting assembly is configured to cut a tape between the first cutting blade and the facing part fully through in a direction of thickness of the tape by moving the first arm to rotate about the first shaft. The half-cutting assembly includes a second cutting blade and a supporting base that face each other in the first direction. The second cutting blade and the supporting base extend in the second direction. The second cutting blade is coupled with a second arm. The second arm is rotatable about a second shaft extending in the third direction. The half-cutting assembly is configured to cut the tape between the second cutting blade and the supporting base partly in the direction of thickness by moving the second arm to rotate about the second shaft. The cam is configured to rotate bidirectionally normally and reversely in directions opposite to each other about a third shaft. The third shaft extends in a third direction. The cam has a cam face, on which a first pressing part configured to press the first arm to rotate about the first shaft when the cam rotates normally and a second pressing part configured to press the second arm to rotate about the second shaft when the cam rotates reversely are arranged. A distance between the cam face and the second arm in the third direction is smaller than or equal to a distance between the cam face and the first arm in the third direction.

According to another aspect of the present disclosure, a printer, having a printing device, a conveyer, and a cutting device, is provided. The printing device is configured to print an image on a tape. The conveyer is configured to convey the tape with the image printed thereon. The cutting device includes a full-cutting assembly, a half-cutting assembly, and a cam. The full-cutting assembly includes a first cutting blade and a facing part, which are configured to face each other in a first direction across the tape conveyed to a position between the first cutting blade and the facing part by the conveyer. The first cutting blade and the facing part extend in a second direction, which intersects with the first direction. The first cutting blade is coupled with a first arm. The first arm is rotatable about a first shaft extending in a third direction, which intersects with the first direction and the second direction. The full-cutting assembly is configured to cut the tape at the position between the first cutting blade and the facing part fully through in a direction of thickness of the tape by moving the first arm to rotate about the first shaft. The half-cutting assembly includes a second cutting blade and a supporting base, which are configured to face each other in the first direction across the tape conveyed to a position between the second cutting blade and the supporting base by the conveyer. The second cutting blade and the supporting base extend in the second direction. The second cutting blade is coupled with a second arm. The second arm is rotatable about a second shaft extending in the third direction. The half-cutting assembly is configured to cut the tape at the position between the second cutting blade and the supporting base partly in the direction of thickness by moving the second arm to rotate about the second shaft. The cam is configured to rotate bidirectionally normally and reversely in directions opposite to each other about a third shaft, which extends in a third direction. The cam has a cam face, on which a first pressing part configured to press the first arm to rotate about the first shaft when the cam rotates normally and a second pressing part configured to press the second arm to rotate about the second shaft when the cam rotates reversely are arranged. A distance between the cam face and the second arm in the third direction is smaller than or equal to a distance between the cam face and the first arm in the third direction.

BRIEF DESCRIPTION OF THE ACCOMPANYING DRAWINGS

Figure 8:
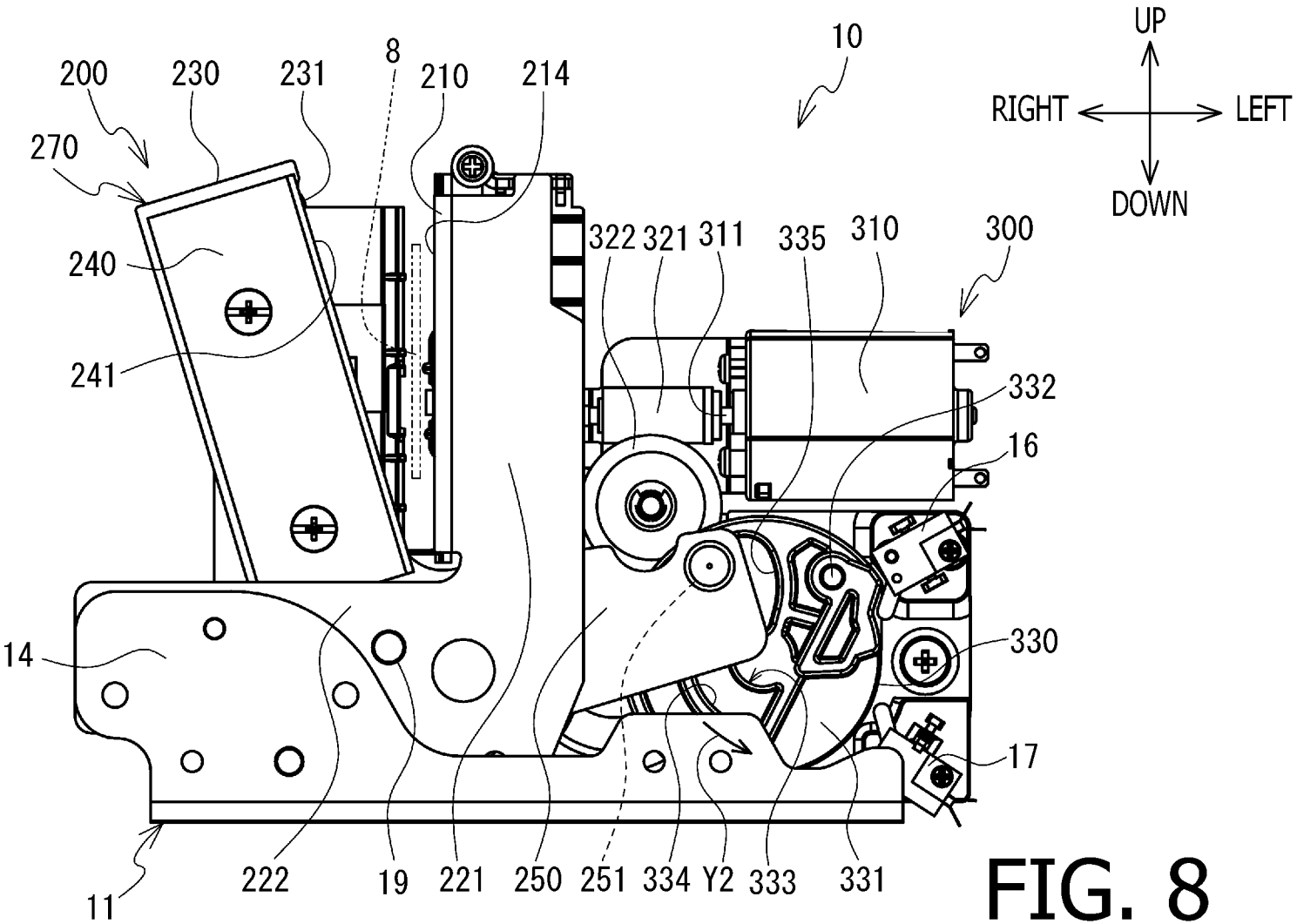

FIG. 8 is a rear view of the cutting device 10, not showing a full-cutting assembly 100, according to the embodiment of the present disclosure, with a half-cutting blade 240 being at a second standby position.

Figure 9:
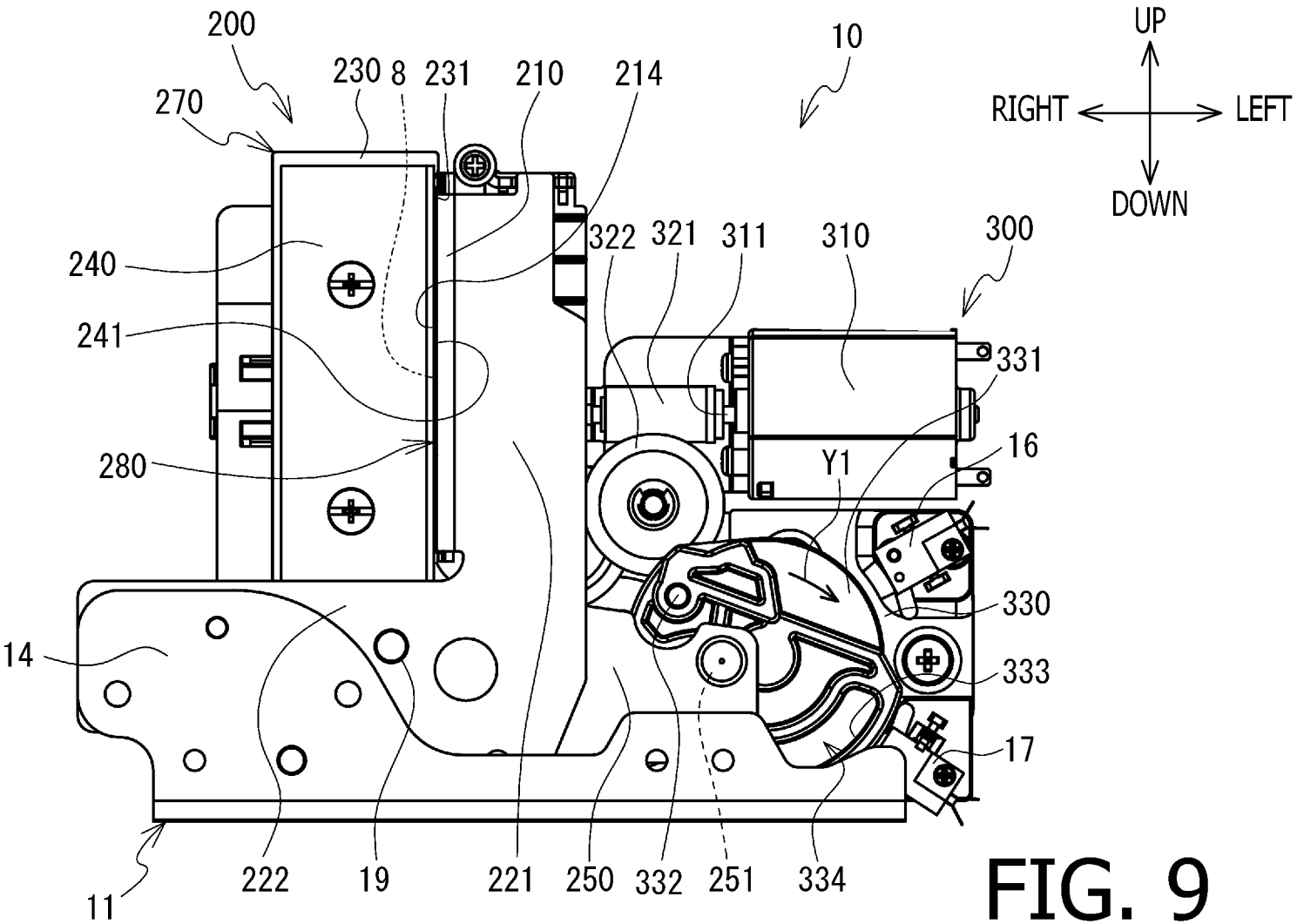

FIG. 9 is a rear view of the cutting device 10, not showing the full-cutting assembly 100, according to the embodiment of the present disclosure, with the half-cutting blade 240 being at a half-cutting position.

Figure 5:
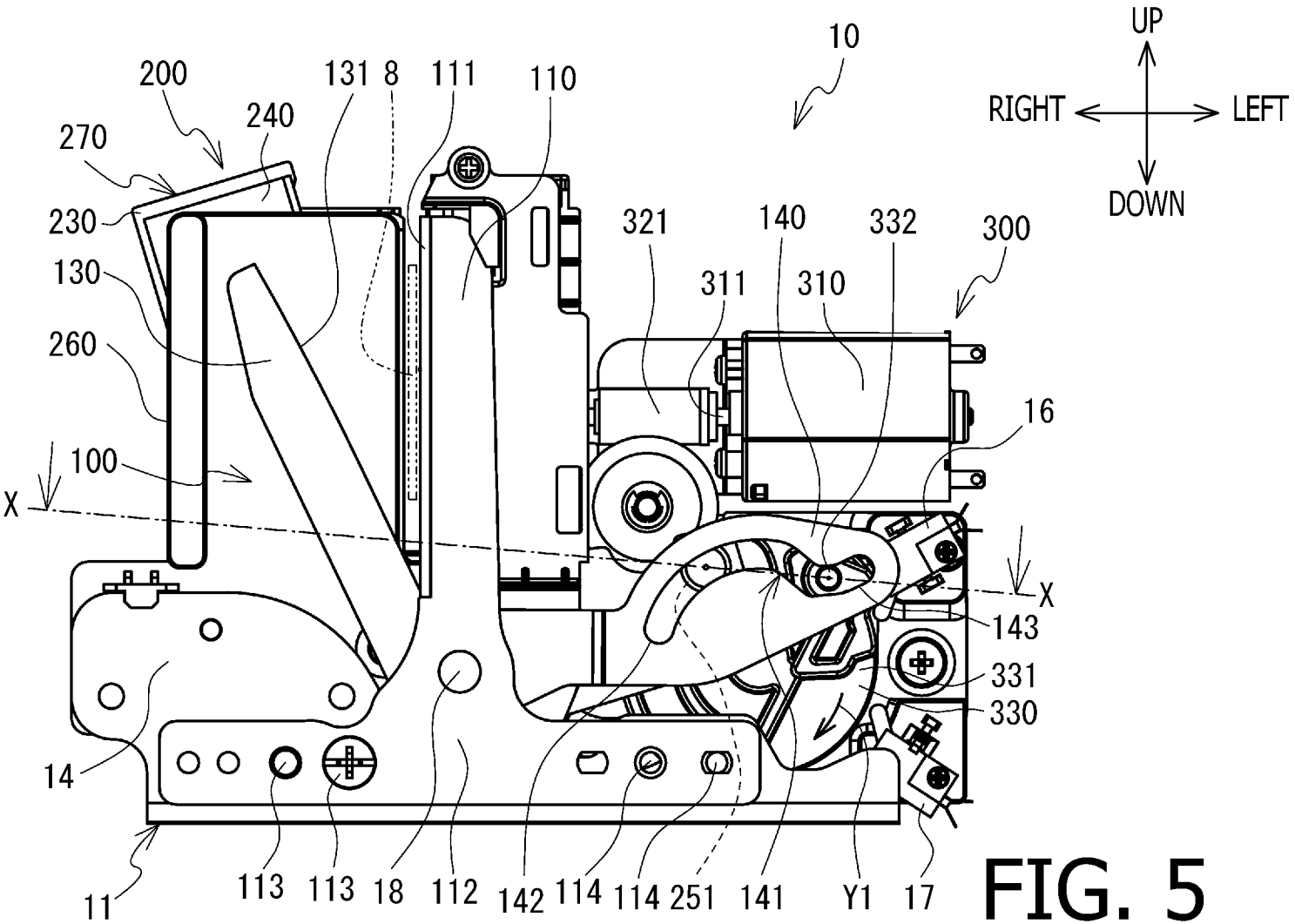
FIG. 5 is a rear view of the cutting device 10 according to the embodiment of the present disclosure with a full-cutting blade 130 being at a first standby position.
Figure 10:
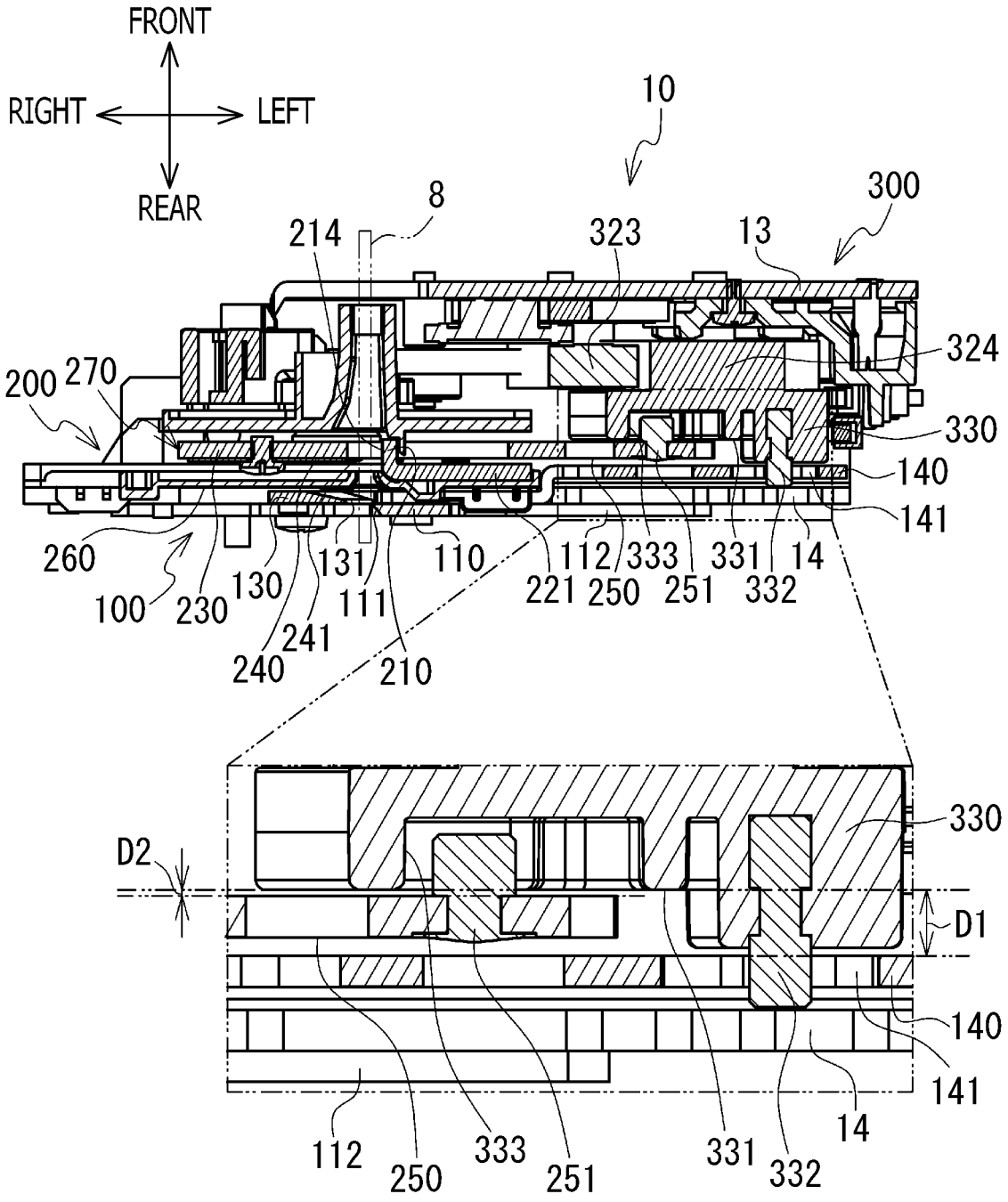

FIG. 10 is a cross-sectional view of the cutting device 10 according to the embodiment of the present disclosure viewed at a line X-X as shown in FIG. 5, which extends through a first pin 332 and a second pin 251.

Figure 11:
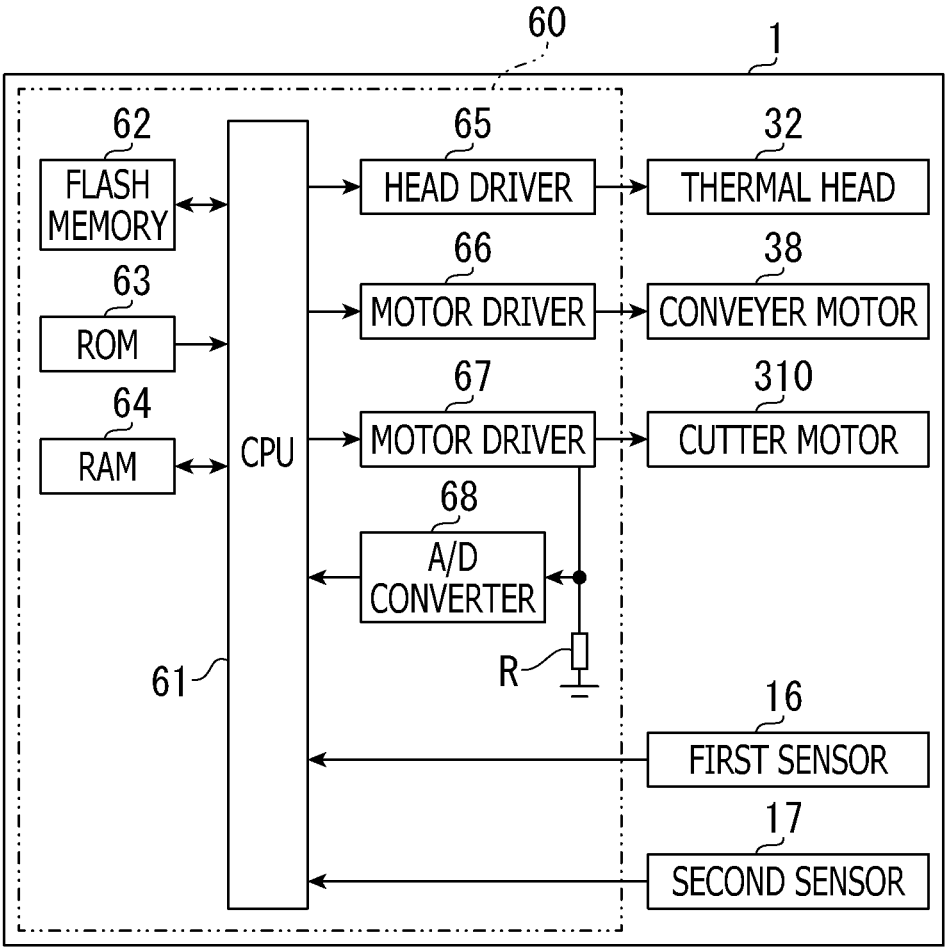

FIG. 11 is a block diagram to illustrate an electric configuration of the printer 1 according to the embodiment of the present disclosure.

Figure 12A:
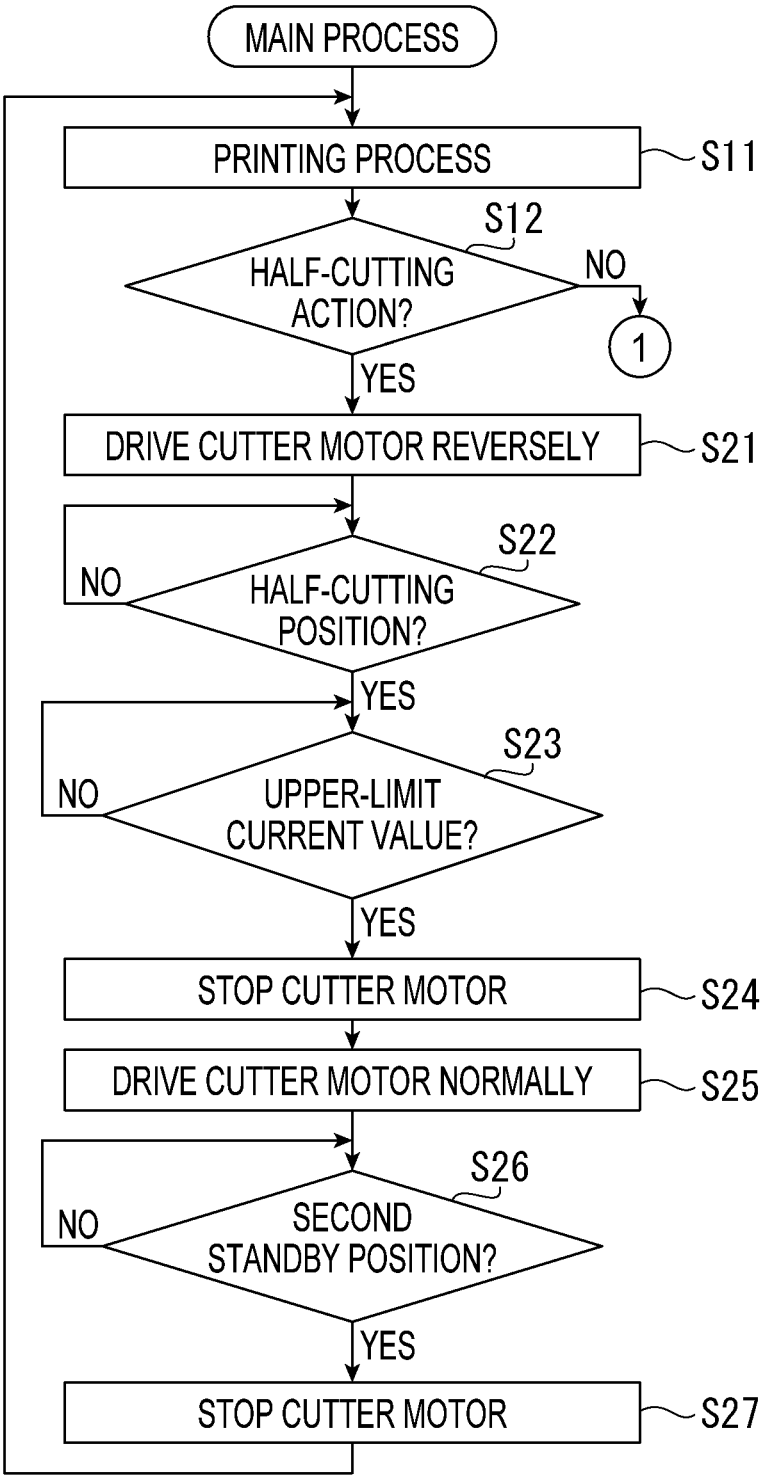
Figure 12B:
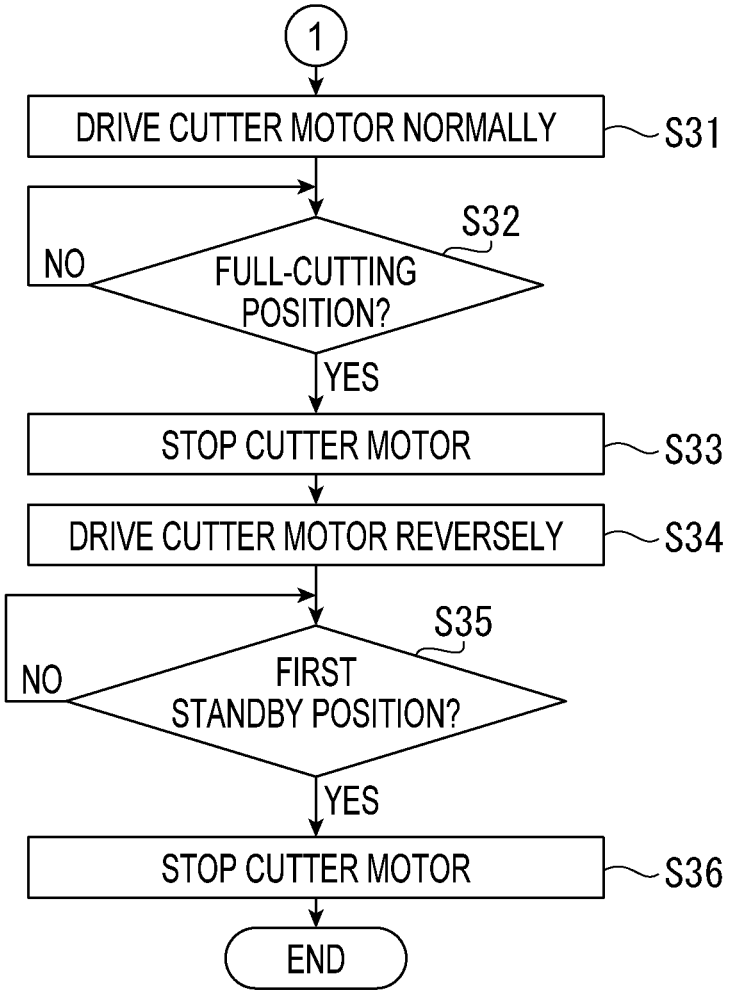

FIGS. 12A-12B are flowcharts to illustrate flows of steps to be executed in a main process in the printer 1 according to the embodiment of the present disclosure.

DETAILED DESCRIPTION

Hereinafter, with reference to the accompanying drawings, described below will be a printer 1 according to the embodiment of the present disclosure. It may be noted that structures of the printer 1 according to the present disclosure may not necessarily be limited to those shown in the accompanying drawings or described in the paragraphs below but may be regarded as merely an example.

In the embodiment described below, directions related the printer 1 and parts and members included in the printer 1 will be mentioned on basis of a posture of the printer 1 with reference to arrows in each drawing. A front-to-rear or rear-to-front direction may be expressed as a front-rear direction, an up-to-down or down-to-up direction may be expressed as a vertical direction, and a left-to-right or right-to-left direction may be expressed as a crosswise direction. The printer 1 may produce a piece of tape 8, on which an image is printed, with use of a tape cassette 9.

Figure 1:
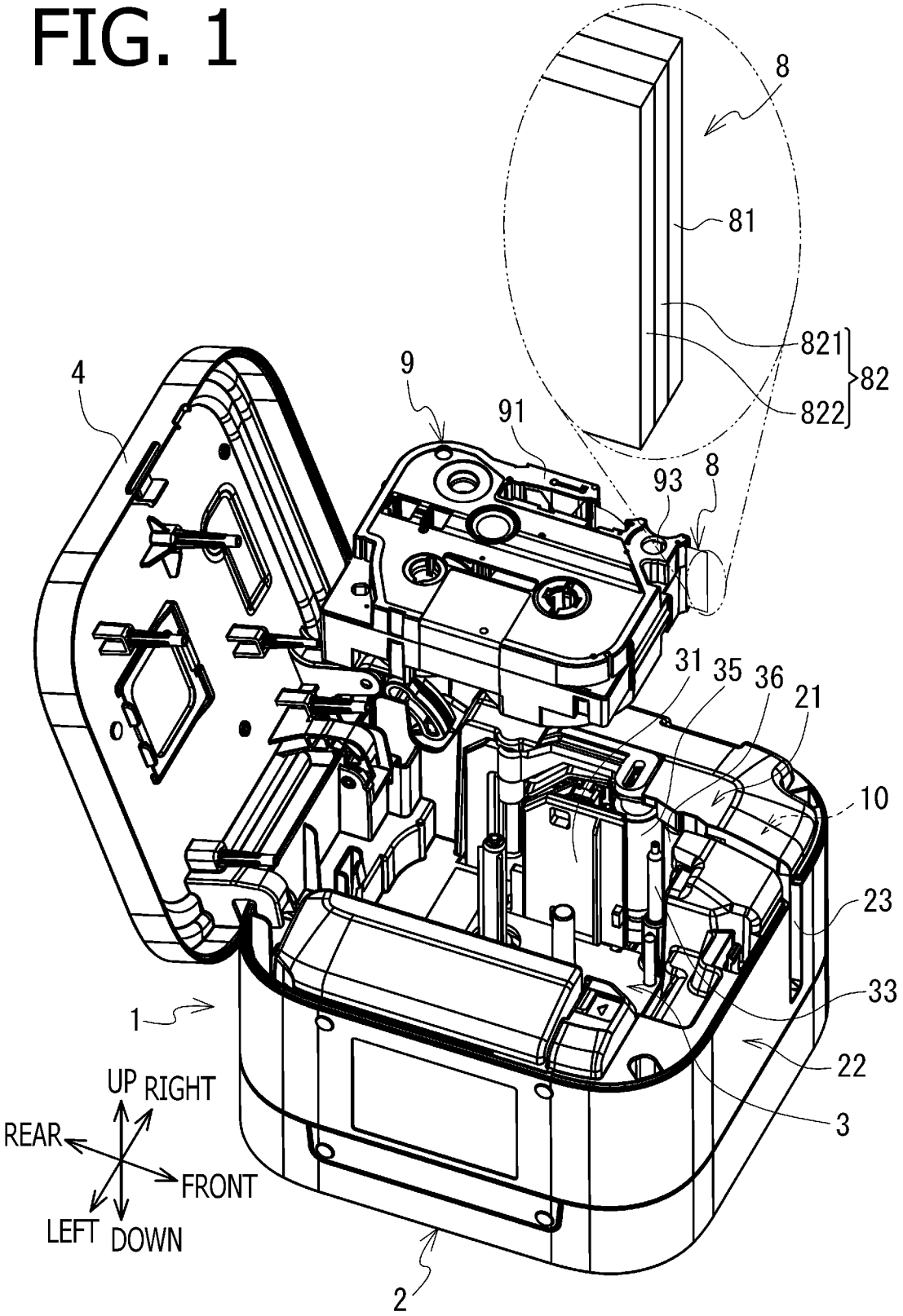
FIG. 1 is a perspective view of a printer according to an embodiment of the present disclosure.
Figure 2:
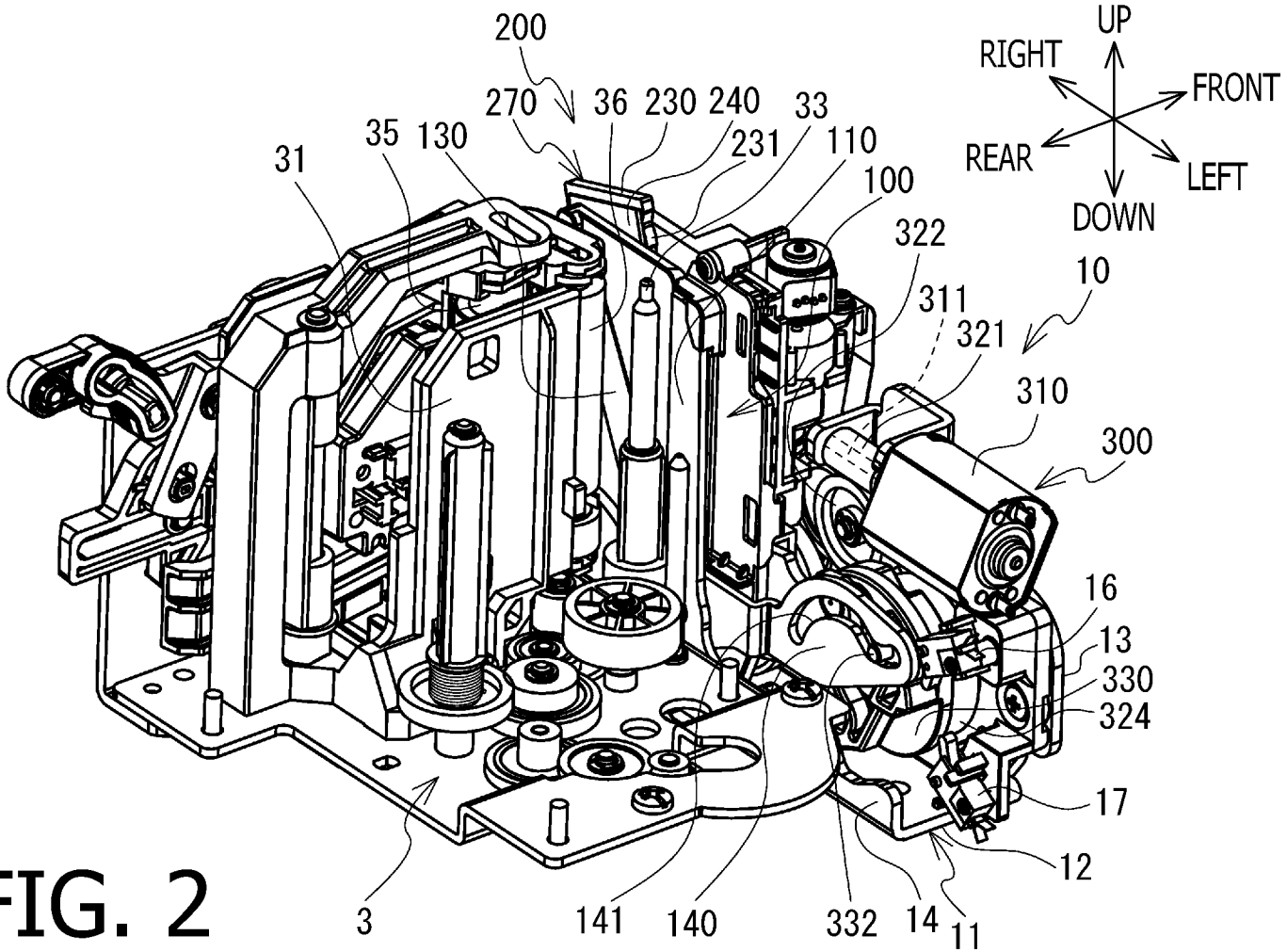
FIG. 2 is a perspective view of an internal structure inside a body case 2 of the printer according to the embodiment of the present disclosure.

With reference to FIGS. 1-2, an overall configuration of the printer 1 will be described. As shown in FIG. 1, the printer 1 includes a body case 2 and a cover 4. The cover 4 is arranged on top of the body case 2 and is openable and closable with respect to the body case 2. On an upper side 21 of the body case 2, arranged is an attachment section 3, which is a room deepened downward. To the attachment section 3, the tape cassette 9 may be detachably attached.

As shown in FIGS. 1-2, in the attachment section 3, a head holder 31 and a tape-feeder rod 33 are arranged. The head holder 31 spreads in a plane in a view along the crosswise direction on a rightward side of the attachment section 3. On a rightward side of the head holder 31, a thermal head 32 (see FIG. 11) is arranged. The thermal head 32 may heat an ink ribbon to print an image on a printable surface of a printable tape 81. The tape-feeder rod 33 extends in the vertical direction at a frontward position with respect to the thermal head 32.

On a rightward side of the head holder 31, a platen roller 35 is arranged. The platen roller 35 faces the thermal head 32 and is movable to approach or separate from the thermal head 32. On a frontward side of the platen roller 35, a pressing roller 36 is arranged. The pressing roller 36 faces the tape-feeder rod 33 and is movable to approach or separate from the tape-feeder rod 33.

On a frontward side of the tape-feeder rod 33, a cutting device 10 for cutting the tape 8 is arranged. The cutting device 10 will be described in detail below. As shown in FIG. 1, on a front face 22 of the body case 2, at a position on a frontward side of the cutting device 10, formed is an outlet 23, through which a piece of the tape 8 cut by the cutting device 10 may be ejected.

With reference to FIG. 1, an overall configuration of the tape cassette 9 will be described below. The tape cassette 9 has a cassette case 91. The cassette case 91 accommodates an ink ribbon (not shown), the printable tape 81, and a sticker tape 82. On the printable tape 81, an image may be printed by transferring the image from the ink ribbon. The sticker tape 82 may be adhered to the printable tape 81, on which the image is printed. At a rightward-front corner of the cassette case 91, a forwarding roller 93. A part of the forwarding roller 93 is exposed to a leftward side of the cassette case 91.

In this configuration of the printer 1 and the tape cassette 9, when the tape cassette 9 is attached to the attachment section 3, the tape-feeder rod 33 is inserted into the forwarding roller 93. With the tape cassette 9 attached to the attachment section 3, when the platen roller 35 approaches the thermal head 32, the platen roller 35 may press the printable tape 81 and the ink ribbon against the thermal head 32. The thermal head 32 may heat the ink ribbon and print the image on the printable tape 81 by the heat.

With the tape cassette 9 attached to the attachment section 3, moreover, the pressing roller 36 may move to be closer to the tape-feeder rod 32 and to the thermal head 32. As the pressing roller 36 approaches the thermal head 32, the pressing roller 36 may press the printable tape 81 and the sticker tape 82 against the forwarding roller 93. As the tape-feeder rod 33 driven by a conveyer motor 38 (see FIG. 11) rotates, the forwarding roller 93 may rotate accordingly. The rotating forwarding roller 93 may produce the tape 8 by causing the sticker tape 82 to adhere to the printable tape 81 at a position between the forwarding roller 93 and the pressing roller 36 and convey the produced tape 8 outward.

The tape 8 may be cut by the cutting device 10 and ejected outside the body case 2 through the outlet 23.

As mentioned above, the tape 8 in the present embodiment may be made of the printable tape 81, on which the image is printed, and the sticker tape 82 adhered to the printable tape 81. In this regard, the tape 8 is formed of a plurality of laminated layers (see a partly enlarged view in FIG. 1).

For example, the printable tape 81 may be a transparent PET tape. The sticker tape 82 may be made of a double-side adhesive tape 821 and a release paper 822 adhered to one side of the double-side adhesive tape 821. The tape 8 may include the printable tape 81 and the double-side adhesive tape 821, the other side of which is adhered to the printable surface of the printable tape 81. In the following paragraphs, a direction, in which the plurality of tapes including the printable tape 81 and the sticker tape 82 are laminated, may be called as a thickness direction. In FIG. 1, the thickness direction coincides with the crosswise direction.

Figure 3:
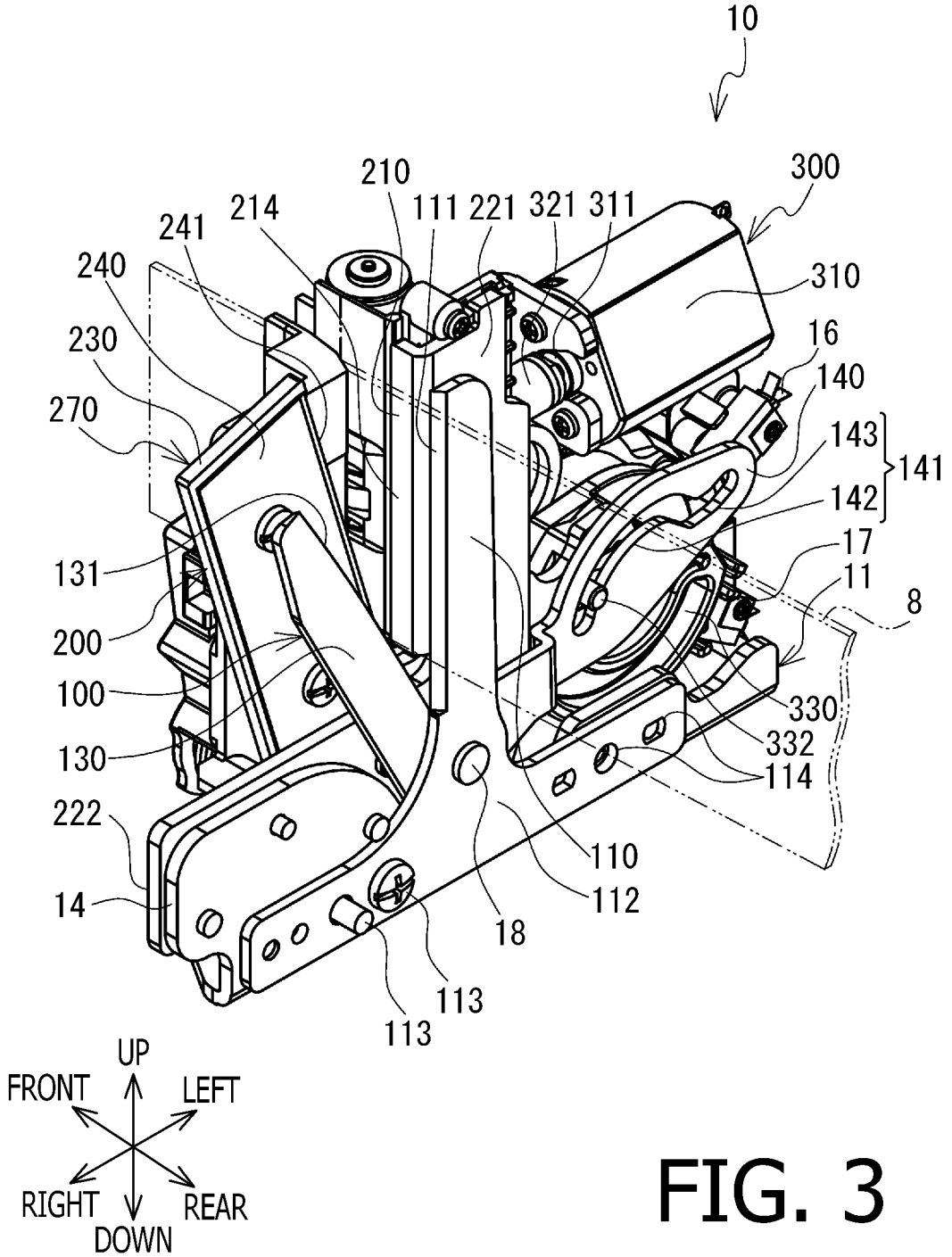
FIG. 3 is a perspective view of a cutting device 10 according to the embodiment of the present disclosure.
Figure 4:
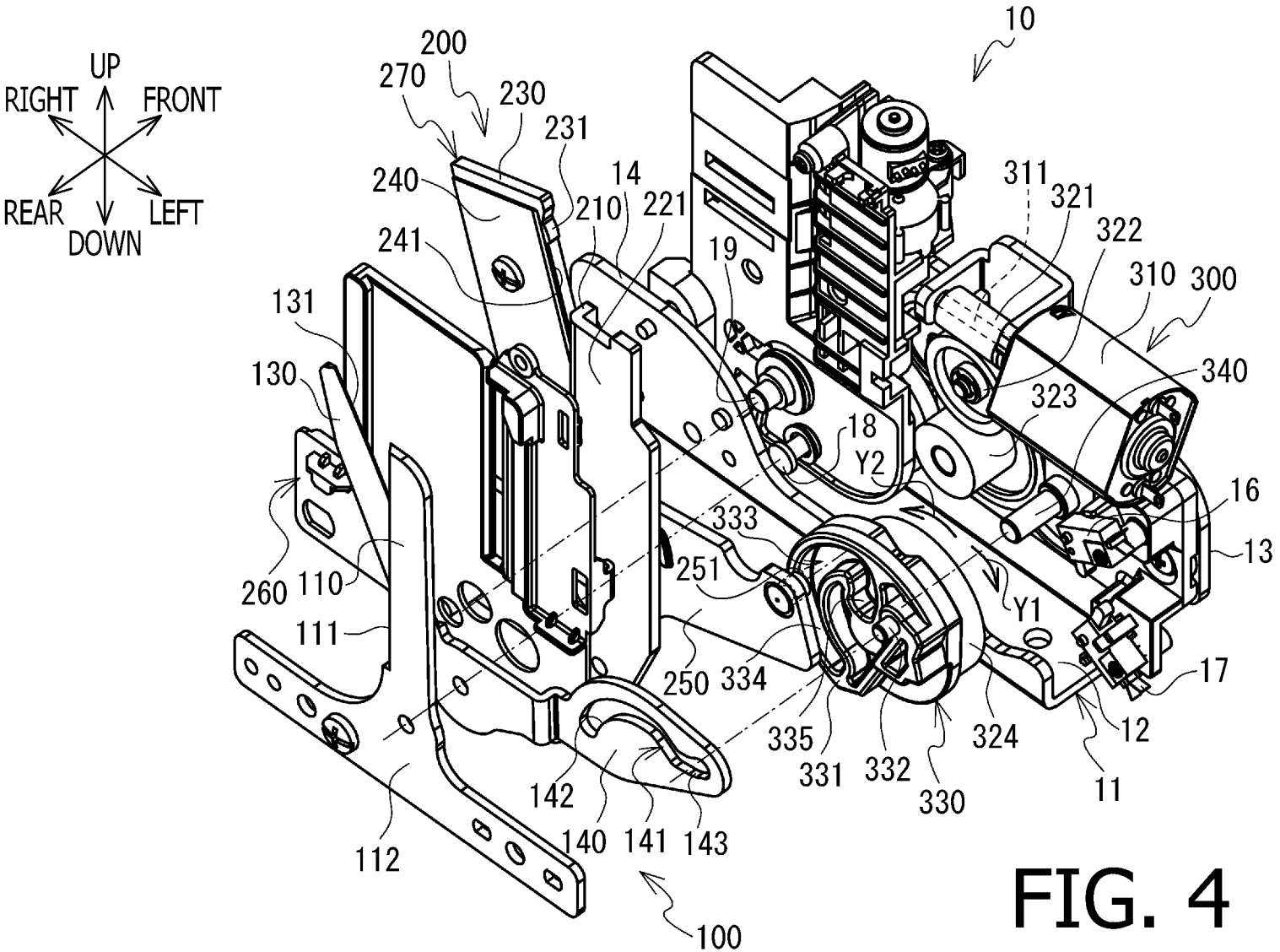
FIG. 4 is an exploded view of the cutting device 10 according to the embodiment of the present disclosure.

With reference to FIGS. 2-9, the cutting device 10 will be described. As shown in FIGS. 2-4, the cutting device 10 includes a full-cutting assembly 100, a half-cutting assembly 200, and a driving assembly 300, which are fixed to a fixing frame 11. The fixing frame 11 has a cross-sectional shape of U and includes a bottom frame 12, a front frame 13, and a rear frame 14. The front frame 13 extends upward from a frontward end of the bottom frame 12. The rear frame 14 extends upward from a rearward end of the bottom frame 12.

The full-cutting assembly 100 may perform a full-cutting action, in which the tape 8 may be cut through fully in the thickness direction. The half-cutting assembly 200 may perform a half-cutting action, in which the tape 8 may be cut halfway, or to an intermediate position, in the thickness direction. The driving assembly 300 may selectively drive either the hill-cutting assembly 100 or the half-cutting assembly 200.

With reference to FIGS. 3-6, the hill-cutting assembly 100 will be described below in detail. As shown in FIGS. 3-4, the full-cutting assembly 100 includes a stationary blade 110 and a full-cutting blade 130. The stationary blade 110 has an approximate shape of a rectangular plate elongated in the vertical direction, in the rear view. A rightward end of the stationary blade 100 forms an edge 111. In this arrangement, the edge 111 points rightward.

From a lower-end position in the stationary blade 110, a fixing part 112 extends rightward and leftward. The stationary blade 110 and the fixing part 112 are formed integrally and together have an approximate shape of T in the rear view. A rightward portion of the fixing part 112 with respect to a crosswise center of the fixing portion 112 is fixed to a rearward face of the rear frame 14 by fixing means 113. A leftward portion of the fixing part 112 with respect to the crosswise center of the fixing part 112 is fixed to the rearward face of the rear frame 14 by fixing means 114. The fixing means 113, 114 may include, for example, a rod-and-hole engagement and screws. The stationary blade 110 may extend upward from a position in the fixing part 112 between the fixing means 113 and the fixing means 114.

The full-cutting blade 130 has an approximate shape of a rectangular plate in the rear view and is located frontward with respect to the stationary blade 110. The full-cutting blade 130 extends along the vertical direction and may face the stationary blade 100 from right across the tape 8 in the rear view. A leftward end of the full-cutting blade 130 forms an edge 131. In this arrangement, the edge 131 points leftward.

With the full-cutting blade 130, a first arm 140 is coupled. The first arm 140 extends leftward from a lower end of the full-cutting blade 130, bends frontward, and bends again to extend leftward. The first arm 140 may be formed integrally with the full-cutting blade 130.

In a leftward part of the first arm 140, a first groove 141 is formed. The first groove 141 includes an arc groove 142 and a pressing groove 143. The arc groove 142 is in a form of an arc centered about a third shaft 340 (see FIG. 4) and is round upward in the rear view. The pressing groove 143 extends from a leftward end of the arc groove 142 in a direction to be farther away from the third shaft 340, e.g., upper-leftward in FIG. 3. In the first groove 141, a first pin 332, which will be described further below, is inserted.

The first arm 140 is supported by a first shaft 18. The first shaft 18 extends rearward from a lower-rightward position in the front frame 13 through a fixing portion 222 (see FIG. 3), which will be described further below, a spacer 260 (see FIG. 4), and a rightward area in the first arm 140, to a lower end area in the stationary blade 110. In this arrangement, the first arm 140 is rotatable about the first shaft 18. As the first arm 140 rotates, the full-cutting blade 130 may rotate about the first shaft 18 to be closer to or farther from the stationary blade 110.

Figure 6:
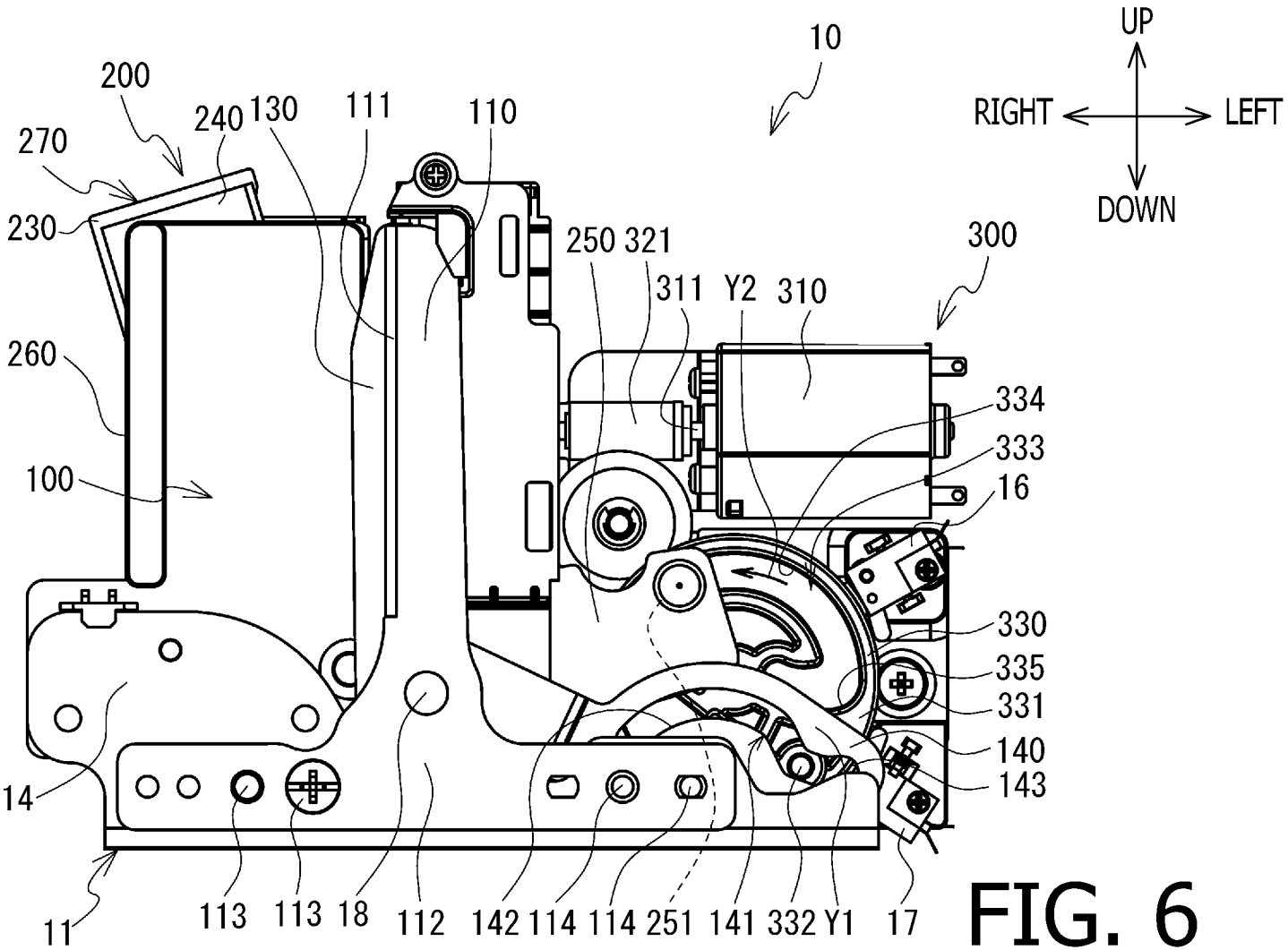
FIG. 6 is a rear view of the cutting device 10 according to the embodiment of the present disclosure with the full-cutting blade 130 being at a full-cutting position.

With the full-cutting assembly 100 in the configuration described above, the full-cutting blade 130 may move between a first standby position (see FIG. 5) and a full-cutting position (see FIG. 6) by rotating about the first shaft 18. As shown in FIG. 5, when the full-cutting blade 130 is at the first standby position, the full-cutting blade 130 is separated rightward from the stationary blade 110. In this arrangement, the full-cutting blade 130 does not overlap the stationary blade 110 in the front-rear direction. On the other hand, when the full-cutting blade 130 is at the full-cutting position, as shown in FIG. 6, the full-cutting blade 130 is closer to the stationary blade 110. In this arrangement, the full-cutting blade 130 overlaps the stationary blade 110 in the front-rear direction.

During the full-cutting action by the full-cutting assembly 100, the first arm 140 rotates, and the full-cutting blade 130 moves from the first standby position (see FIG. 5) to the full-cutting position (see FIG. 6); therefore, the edge 131 of the full-cutting blade 130 slides to intersect with the edge 111 of the stationary blade 110 in the rear view. Thereby, the tape 8 caught between the edge 111 of the stationary blade 110 and the edge 131 of the full-cutting blade 130 may be cut fully through in the thickness direction, in a so-called scissors fashion.

With reference to FIGS. 3, 4, and 7-10, the half-cutting assembly 200 will be described below in detail. As shown in FIGS. 3-4, the half-cutting assembly 200 includes a supporting base 210 and a cutter section 270. The supporting base 210 is located frontward with respect to the full-cutting blade 130 across the spacer 260 (see FIG. 4). It may be noted that FIG. 3 does not illustrate the spacer 260 for simplicity of explanation.

The supporting base 210 has a form of a rectangular plate elongated in the vertical direction in the rear view. From a rear end of the supporting base 210, an extended part 221 extends leftward. From a lower end of the extended part 221, a fixing part 222 extends rightward. The fixing part 222 is fixed to a front face of the rear frame 14.

The cutter section 270 may face the supporting base 210 across the tape 8 and includes a holder 230 and a half-cutting blade 240. The holder 230 has a form of a rectangular plate in the rear view and is located frontward with respect to the fixing part 222. The half-cutting blade 240 is fixed to a rear face of the holder 230. The half-cutting blade 240 has a form of a rectangular plate in the rear view and extends along the vertical direction. A leftward end of the half-cutting blade 240 forms an edge 241. Therefore, the edge 241 points leftward. The edge 241 protrudes leftward from a leftward end of the holder 230.

As shown in FIG. 4, the cutting part 270 is coupled with a second arm 250. The second arm 250 is located frontward with respect to the first arm 140 and extends leftward from a lower end of the holder 230. The second arm 250 may be formed integrally with the holder 230. In a leftward end area of the second arm 250, a second pin 251 is arranged. The second pin 251 protrudes frontward from a front face of the second arm 250 and is inserted in a second groove 333, which will be described further below.

The second arm 250 is supported by a second shaft 19. The second shaft 19 is located at a position upper-rightward with respect to the first shaft 18 and rightward with respect to the second pin 251. The second shaft 19 extends rearward from a lower-rightward area in the front frame 13 through a rightward area in the second arm 250 to the fixing part 222. In this arrangement, the second arm 250 is rotatable about the second shaft 19. As the second arm 250 rotates, the cutter section 270 may rotate about the second shaft 19 to be closer to or farther from the supporting base 210.

The cutter section 270 includes a protrusive part 231, which protrudes in a direction, at which the edge 241 points, i.e., leftward, toward the supporting base 210 from an upper area on a leftward end of the holder 230. The protrusive part 231 may be formed integrally with the holder 230. A protrusive amount of the protrusive part 231 from the leftward end of the holder 230 is larger than a protrusive amount of the edge 241 from the leftward end of the holder 230. In this arrangement, the protrusive end of the protrusive part 231 is located leftward with respect to the edge 241 (see FIG. 8).

Figure 7:
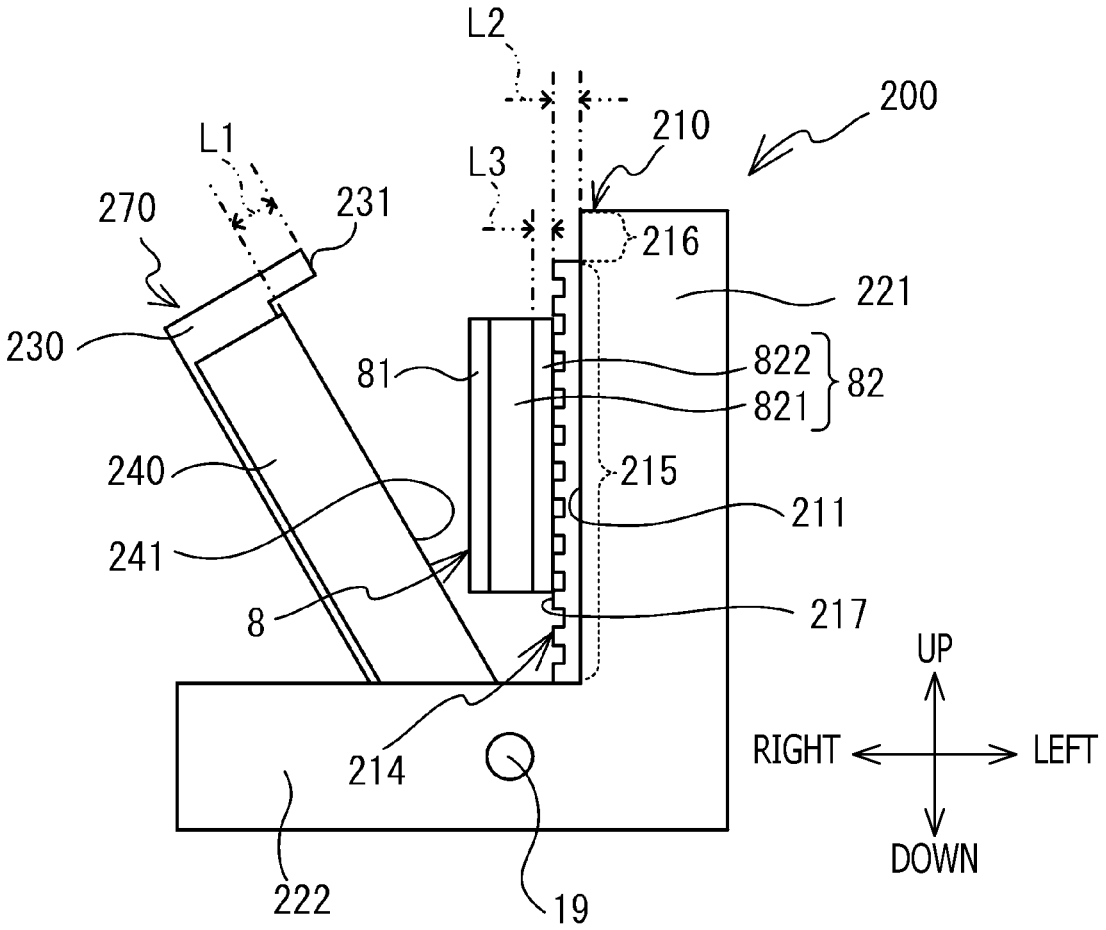
FIG. 7 is an illustrative rear view of a half-cutting assembly 200 in the cutting device 10 according to the embodiment of the present disclosure.

With reference to FIG. 7, the supporting base 210 will be described below in detail. It may be noted that in FIG. 7, in order to clearly show relativity in sizes among the parts in the supporting base 210, some of the parts may be illustrated in exaggerated sizes. The supporting base 210 has a supporting surface 214 on a rightward side thereof. The supporting surface 214 is a surface of the supporting base 210 exposed rightward. The supporting base 210 has a placement area 215 and a contact area 216, which are distinct or different from each other, on the supporting surface 214. In other words, the supporting surface 214 is divided into, but not limited to, the placement area 215 and the contact area.

The contact area 216 is in a part of the supporting surface 214 closer to an upper end of the supporting base 210. The placement area 215 is in a part of the supporting surface 214 lower than the contact area 216 and farther from the upper end of the supporting base 210. In this regard, in the rear view, a distance from the second shaft 19 to the contact area 216 is greater than a distance from the second shaft 19 to the placement area 215. The tape 8 being conveyed by the pressing roller 36 and the forwarding roller 93 may pass through a position between an upper end and a lower end of the placement area 215. In other words, the tape 8, having been conveyed by the pressing roller 36 and the forwarding roller 93, placed on the supporting surface 214 may be located in the placement area 215.

The supporting base 210 has a stainless plane 211, which is partly coated. The stainless plane 211 including the partial coating forms the supporting base 210. More specifically, the supporting base 210 has the supporting surface 214, in the placement area 215 of which the stainless plane 211 has a resin-coating layer 214 thereon. In other words, with regard to the placement area 215, the supporting surface 214 is formed of the resin-coating layer 214. Therefore, the stainless plane 211 is not exposed in the placement area 215 of the supporting surface 214.

In the contact area 216 of the supporting surface 214, on the other hand, the stainless plane 211 has no resin-coating layer. In other words, the stainless plane 211 is not coated in the contact area 216 of the supporting surface 214. Therefore, the stainless plane 211 is exposed rightward in the contact area 216 on the supporting surface 214. In other words, with regard to the contact area 216, the supporting surface 214 is formed of the stainless plane 211. Thus, in the placement area 215 alone between the placement area 215 and the contact area 216, the supporting surface 214 is formed of the resin-coating layer 217.

The resin-coating layer 217 has an uneven surface with, for example, concavities and convexities. For example, protrusive strips linearly extending along the front-rear direction may align vertically in the resin-coating layer 217. A surface roughness of the supporting surface 214 in the placement area 215 (i.e., a surface roughness of the resin-coating layer 217) is greater than a surface roughness of the supporting surface 214 in the contact area 216 (i.e., a surface roughness of the stainless plane 211). A hardness of the supporting surface 214 in the contact area 214 (i.e., a hardness of the stainless plane 211) is greater than a hardness of the supporting surface 214 in the placement area 215 (i.e., a hardness of the resin-coating layer 217). In the present embodiment, the hardness refers to indentation hardness and may be expressed by so-called Brinell hardness.

A thickness L2 of the resin-coating layer 217 is smaller than a distance L1 between the edge 241 of the half-cutting blade 240 and the protrusive end of the protrusive part 231 in the pointing direction of the edge 241. For example, the distance L1 may be in a range of 20 μm-25 μm. A difference between the distance L1 and the thickness L2 is smaller than a thickness L3 of the release paper 822.

According to the arrangement of the half-cutting assembly 200 described above, as the cutter section 270 rotates about the second shaft 19, the half-cutting blade 240 may move between a second standby position (see FIG. 8) and a half-cutting position (see FIG. 9). As shown in FIG. 8, when the half-cutting blade 240 is located at the second standby position, the protrusive part 231 is separated rightward from the supporting surface 214. On the other hand, when the half-cutting blade 240 is located at the half-cutting position, as shown in FIG. 9, the protrusive part 231 contacts the supporting surface 214 in the contact area 216 (see FIG. 7). In this arrangement, a clearance 280 is formed between the supporting surface 214 in the contact area 215 and the edge 241.

In order to perform the half-cutting action, while the tape 8 is located in the placement area 215 of the supporting surface 214, the half-cutting blade 240 may move along with the rotation of the second arm 250 from the second standby position (see FIG. 8) to the half-cutting position (see FIG. 9). Thereby, the tape 8 may be set in the clearance 280, which is between the half-cutting blade 240 and the supporting base 210. With the tape 8 set in the clearance 280, the protrusive part 231 may press the supporting surface 214 in the contact area 216, and the tape 8 set in the clearance 280 may be pressed by the edge 241 of the half-cutting blade 240 against the supporting surface 214 and cut halfway.

A length of the clearance 280 in the crosswise direction is equal to the difference between the distance L1 and the thickness L2 and is therefore smaller than the thickness L3.

Moreover, the thickness L2 is smaller than the distance L1; therefore, the length of the clearance 280 in the crosswise direction is greater than zero (0). In this arrangement, when the half-cutting blade 240 moves to the half-cutting position, the edge 241 moving rightward from the side of the printable tape 81 of the tape 8 may wedge into an approximately midst position of the release paper 822 in the thickness direction. In this half-cutting action, the printable tape 81 and the double-side adhesive tape 821 may be cut through while the release paper 822 may be left uncut. In this regard, it may be noted that the half-cutting assembly 200 may not necessarily cut the tape 8 to a midst position of the tape 8 in the thickness direction as long as the printable tape 81 and the double-side adhesive tape 821 are cut through while the release paper 822 may be left uncut.

With reference to FIGS. 4 and 10, the driving assembly 300 will be described below in detail. As shown in FIG. 4, the driving assembly 300 includes a cutter motor 310, a plurality of gears 321-324, and a cam 330. The cutter motor 310 is fixed to an upper-leftward area in the front frame 13 and located at a position to vertically overlap a third shaft 340, which will be described below. The cutter motor 310 has a rotation shaft 311, which protrudes rightward from a rightward face of the cutter motor 310.

The gear 321 is fixed to the rotation shaft 311. The gear 322 is located on a lower side of the gear 321 and meshes with a lower end of the gear 321. The gear 323 is located on a lower side of the gear 322 and meshes with a lower end of the gear 322. The gear 324 is located on a leftward side of the gear 323 and meshes with a leftward end of the gear 323.

The cam 330 is fixed to a rearward face of the gear 324. The cam 330 and the gear 324 may be formed integrally. The gear 324 is supported by the third shaft 340. The third shaft 340 extends rearward from a leftward area in the front frame 13 and is inserted in a center of the gear 324. In this arrangement, the cam 330 may rotate along with the gear 324 about the third shaft 340 bidirectionally, either in a direction Y1 or a direction Y2. The direction Y1 and the direction Y2 are rotational directions that are opposite to each other. For example, the direction Y1 may be a clockwise direction, and the direction Y2 may be a counterclockwise direction, in the rear view.

In the following paragraphs, rotation of the cam 330 about the third shaft 340 in the direction Y1 may be referred to as normal rotation, or rotating normally, and rotation of the cam 330 about the third shaft 340 in the direction Y2 may be referred to as reverse rotation, or rotating reversely. The cam 330 may transmit a driving force from the cutter motor 310 selectively to either the first arm 140 or the second arm 250 by rotating normally or reversely.

A rearward face of the cam 330 forms a cam face 331. The cam face 331 is a reference surface, from which unevenness to transmit the force protrudes or recesses. The cam face 331 spreads orthogonally to the third shaft 340. When, for example, the rear face of the cam 300 has tiered surfaces, one of the tiered surfaces may serve as the cam face 331 being the reference surface.

On the cam face 331, in particular, a first pin 332 and a second groove 333 are arranged. The first pin 332 protrudes rearward from the cam face 33 and is inserted in the first groove 141. The second groove 333 is dented frontward from the cam face 331 and includes an arc groove 334 and a pressing groove 335. The arc groove 334 is in a form of an arc centered about the third shaft 340 and is round rightward in the rear view. The pressing groove 335 extends from an upper end of the arc groove 334 to be closer to the third shaft 340, e.g., downward in FIG. 4, in the rear view. In the second groove 333, a second pin 251 is inserted.

As shown in FIG. 10, a distance D2 between the cam face 331 and the second arm 250 in the front-rear direction is smaller than a distance D1 between the cam face 331 and the first arm 140 in the front-rear direction. Transmission rates to transmit the force from the cam 330 to the first arm 140 and to the second arm 250 depend on the distances D1, D2, respectively. In particular, the transmission rates to transmit the force from the cam 330 to the first arm 140 and to the second arm 250 increase when the distances D1, D2 are shorter. Therefore, while in the present embodiment the distance D2 is shorter than the distance D1, the transmission rate to transmit the force from the cam 330 to the second arm 250 is greater than the transmission rate for the force from the cam 330 to the first arm 140.

In the driving assembly 300 described above, the driving force of the cutter motor 310 is transmittable from the rotation shaft 311 through the gears 321-324 to the cam 330. The cutter motor 310 may drive the rotation shaft 311 to rotate in one of two (2) directions that are opposite to each other. In the following paragraphs, an act of the cutter motor 310 to drive the rotation shaft 311 in one direction to cause the normal rotation (i.e., the direction Y1) of the cam 330 may be called as normal driving or driving normally, and an act of the cutter motor 310 to drive the rotation shaft 311 in the other direction to cause the reverse rotation (i.e., the direction Y2) of the cam 330 may be called as reverse driving or driving reversely.

The driving assembly 300 may switch the rotation of the cam 330 between the normal rotation and the reverse rotation by switching the cutter motor 310 between the normal driving and the reverse driving. The cam 330 may transmit the force to either the first arm 140 or the second arm 250 through the first pin 332 and the second groove 333 selectively by being driven normally or reversely. Thereby, the driving assembly 300 may perform either full-cutting action or the half-cutting action selectively.

In the half-cutting action, when the half-cutting blade 240 reaches the half-cutting position (see FIG. 8), the protrusive part 231 is pressed against the supporting base 210. On the other hand, in the full-cutting action, when the full-cutting blade 130 reaches the full-cutting position (see FIG. 5), the full-cutting blade 130 intersects with the stationary blade 110, and the full-cutting blade 130 may not be pressed against the stationary blade 110. Therefore, a driving load on the second arm 250 during the half-cutting action may be greater than a driving load on the first arm 140 during the full-cutting action. Moreover, the transmission rate from the cam 330 to the second arm 250 is greater than the transmission rate from the cam 330 to the first arm 140. Therefore, a maximum driving load on the cam 330 may be restrained from increasing to be as large as a driving load on the cam 330 when, for example, the transmission rate from the cam 330 to the second cam 250 is smaller than the transmission rate from the cam 330 to the first arm 140.

In the present embodiment, meanwhile, the driving load on the second arm 250 during the half-cutting action is notably greater than the driving load on the first arm 140 during the full-cutting action. Therefore, the load to be applied to the cam 330 is greater during the half-cutting action than during the full-cutting action. In this respect, the driving load to be applied to the cam 330 during the half-cutting action by the half-cutting assembly 200 may be the maximum driving load to the cam 330. Similarly, the driving load on the cam 330 during the half-cutting action by the half-cutting assembly 200 may be the maximum driving load to the cutter motor 310.

With reference to FIG. 11, an electrical configuration of the printer 1 will be described in detail below. The printer 1 includes a controller 60. The controller 60 includes a CPU 61. The CPU 61 may control the printer 1. The CPU 61 is connected with a flash memory 62, a ROM 63, a RANI 64, a head driver 65, motor drivers 66, 67, an A/D converter 68, a first sensor 16, and a second sensor 17. The flash memory 62 stores programs that may cause the CPU 61 to execute a main process (see FIGS. 12A-12B), which will be described further below. The ROM 63 stores information such as parameters that may be required by the CPU 61 to execute the programs. The RAM 64 may store, for example, print data, temporarily.

To the head driver 65, a thermal head 32 is connected. The CPU 61 may control the thermal head 32 through the head driver 65. To the motor driver 66, a conveyer motor 38 is connected. The CPU 61 may control the conveyer motor 38 through the motor driver 66. To the motor driver 67, the cutter motor 310 is connected. The CPU 61 may control the cutter motor 310 through the motor driver 67.

To the motor driver 67, further, one end of a resistance R and the A/D converter 68 are connected. The other end of the resistance R is grounded. The motor driver 67 may output a current, of which amount is equal to an amount of a current flowing through the cutter motor 310, to the resistance R. Thereby, at each end of the resistance R, a voltage, of which intensity corresponds to the current provided to the resistance R, is generated. The A/D converter 68 may output signals corresponding to the level of the voltage generated between the ends of the resistance R to the CPU 61. Thus, based on the signals output from the A/D converter 68, the CPU 61 may determine the voltage level generated between the ends of the resistance R. Based on the relation between the determined voltage level and the resistance R, the CPU 61 may detect the amount of the current flowing through the cutter motor 310. Thus, the CPU 61 may control the cutter motor 310 in response to the driving load applied to the cam 330.

The first sensor 16 and the second sensor 17 are arranged to align vertically at positions leftward with respect to the cam 330 (see FIG. 2) and may output signals corresponding to a rotational position of the cam 330. Therefore, the CPU 61 may determine the positions of the full-cutting blade 130 and the half-cutting blade 240 based on the signals output from the first sensor 16 and the second sensor 17.

With reference to FIGS. 12A-12B, the main process will be described below. With the tape cassette 9 attached to the attachment section 3, the printer 1 may be powered on by a user, and the CPU 61 may call the program from the flash memory 62 to start the main process.

As the main process starts, in S11 (see FIG. 12A), the CPU 61 conducts a printing process, in which the CPU 61 may control the thermal head 32 and the conveyer motor 38 based on the print data. Thereby, the tape 8 with an image printed thereon may be produced.

In S12, the CPU 61 determines whether the print data indicates a half-cutting action should be performed. If the print data indicates the half-cutting action should be performed (S12: YES), the CPU 61 controls the half-cutting assembly 200 to perform the half-cutting action (see FIG. 12A). If the print data indicates a full-cutting action should be performed (S12: NO), the CPU 61 controls the full-cutting assembly 100 to perform the full-cutting action (see FIG. 12B). In the following paragraphs, a state, in which the full-cutting blade 130 is located at the first standby position (see FIG. 5) and the half-cutting blade 240 is located at the second standby position (see FIG. 8) will be called as a standby state.

The half-cutting action will be described below. In S21, the CPU 61 starts driving the cutter motor 31 reversely from the standby state (see FIG. 8) to start the half-cutting action. The reverse driving of the cutter motor 31 may cause the cam 330 to rotate reversely, i.e., in the direction Y2. When the cam 330 rotates reversely, the second pin 251 moves in the pressing groove 335, and an upper edge of the pressing groove 335 presses the second pin 251 to pivot downward about the second shaft 19. Thereby, the second arm 250 rotates clockwise about the second shaft 19 in the rear view. As the second arm 250 rotates, the half-cutting blade 240 moves from the second standby position (see FIG. 8) toward the half-cutting position (see FIG. 9).

Meanwhile, when the cam 330 rotates reversely from the standby state, the first pin 332 moves in the arc groove 142 without pressing the first arm 140 (see FIG. 5). Therefore, the full-cutting blade 130 may stay located at the first standby position (see FIG. 5).

In S22, based on the signals from the first sensor 16 and the second sensor 17, the CPU 61 determines whether the half-cutting blade 240 reached the half-cutting position (see FIG. 9). If the half-cutting blade 240 has not reached the half-cutting position (S22: NO), the CPU 61 continues driving the cutter motor 310 reversely and repeats S22.

When the half-cutting blade 240 reached the half-cutting position (S22: YES), in S23, the CPU 61 determines whether the level of the current flowing through the cutter motor 310 exceeds a predetermined upper-limit current value. The upper-limit current value may be prepared in advance in the ROM 63 and correspond to an intensity of the driving load that enables the half-cutting assembly 200 to cut the tape 8 halfway reliably.

If the amount of the current flowing through the cutter motor 310 is lower than or equal to the upper-limit current value (S23: NO), the CPU 61 continues driving the cutter motor 310 reversely and repeats S23. In this arrangement, in the half-cutting action, the reverse driving of the cutter motor 310 may not be stopped as soon as the half-cutting blade 240 reaches the half-cutting position (see FIG. 9) but may be maintained until the amount of the current flowing through the cutter motor 310 exceeds the upper-limit current value. Therefore, a state, in which the protrusive part 231 is pressed against the supporting surface 214, may continue for a predetermined length of time, and the cutter motor 310 may need to bear a large intensity of driving load.

When the amount of the current flowing through the cutter motor 310 exceeds the upper-limit current value (S23: YES), in other words, when the predetermined intensity of the driving load is applied to the cutter motor 310, in S24, the CPU 61 stops the reverse driving of the cutter motor 310. By the action described above, the tape 8 may be cut halfway. Thus, the CPU 61 may control operations of the cutter motor 310 according to the amount of the current flowing through the cutter motor 310 after the half-cutting blade 240 reaches the half-cutting position. Therefore, the printer 1 may cut the tape 8 halfway reliably by the steady intensity. In this regard, the tape 8 may be restrained from being cut insufficiently.

In S25, the CPU 61 drives the cutter motor 310 normally. The normal driving of the cutter motor 31 may cause the cam 330 to rotate normally, i.e., in the direction Y1. When the cam 330 rotates normally, the second pin 251 moves in the pressing groove 335, and a lower edge of the pressing groove 335 presses the second pin 251 to pivot upward about the second shaft 19. Thereby, the second arm 250 rotates counterclockwise about the second shaft 19 in the rear view. As the second arm 250 rotates, the half-cutting blade 240 moves from the half-cutting position (see FIG. 9) toward the second standby position (see FIG. 8).

Meanwhile, when the cam 330 rotates normally from the state, in which the half-cutting blade 240 is located at the half-cutting position, the first pin 332 may move along the arc groove 142, in a direction opposite to the direction when the cam 330 rotates reversely from the standby state, without pressing the first arm 140. Therefore, the full-cutting blade 130 may stay located at the first standby position (see FIG. 5).

In S26, based on the signals from the first sensor 16 and the second sensor 17, the CPU 61 determines whether the half-cutting blade 240 reached the second standby position (see FIG. 8). If the half-cutting blade 240 has not reached the second standby position (S26: NO), the CPU 61 continues driving the cutter motor 310 normally and repeats S26. When the half-cutting blade 240 reaches the second standby position (S26: YES), in S27, the CPU 61 stops the normal driving of the half-cutting blade 240. Thereby, the cutter 10 shifts to the standby state, and the half-cutting action ends thereat. The CPU 61 returns to S11.

The full-cutting action will be described below. In S31 (see FIG. 12B), the CPU 61 starts driving the cutter motor 31 normally from the standby state (see FIG. 5) to start the full-cutting action. The normal driving of the cutter motor 31 may cause the cam 330 to rotate normally, i.e., in the direction Y1. When the cam 330 rotates normally, the first pin 332 moves in the pressing groove 143 and presses the leftward part of the first arm 140 with respect to the first shaft 18 to pivot downward about the first shaft 18. Thereby, the first arm 140 rotates clockwise about the first shaft 18 in the rear view. As the first arm 140 rotates, the full-cutting blade 130 moves from the first standby position (see FIG. 5) toward the full-cutting position (see FIG. 6).

Meanwhile, when the cam 330 rotates normally from the standby state, the second pin 251 moves in the arc groove 334 without pressing the second arm 250 (see FIG. 8). Therefore, the half-cutting blade 240 may stay located at the second standby position (see FIG. 8).

In S32, based on the signals from the first sensor 16 and the second sensor 17, the CPU 61 determines whether the full-cutting blade 130 reached the full-cutting position (see FIG. 6). If the full-cutting blade 130 has not reached the full-cutting position (S32: NO), the CPU 61 continues driving the cutter motor 310 normally and repeats S32. When the full-cutting blade 130 reached the full-cutting position (S32: YES), in S33, the CPU 61 stops the normal driving of the cutter motor 310. By the action described above, the tape 8 may be cut fully.

In S34, the CPU 61 drives the cutter motor 310 reversely. The reverse driving of the cutter motor 31 may cause the cam 330 to rotate reversely, i.e., in the direction Y2. When the cam 330 rotates reversely, the first pin 332 moves in the pressing groove 143 and presses the leftward part of the first arm 140 with respect to the first shaft 18 to pivot upward about the first shaft 18. Thereby, the first arm 140 rotates counterclockwise about the first shaft 18 in the rear view. As the first arm 140 rotates, the full-cutting blade 130 moves from the full-cutting position (see FIG. 6) toward the first standby position (see FIG. 5).

Meanwhile, when the cam 330 rotates reversely from the state, in which the full-cutting blade 130 is located at the full-cutting position, the second pin 251 may move in the arc groove 334, in a direction opposite to the direction when the cam 330 rotates normally from the standby state, without pressing the second arm 250. Therefore, the half-cutting blade 240 may stay located at the second standby position (see FIG. 8).

In S35, based on the signals from the first sensor 16 and the second sensor 17, the CPU 61 determines whether the full-cutting blade 130 reached the first standby position (see FIG. 6). If the full-cutting blade 130 has not reached the first standby position (S35: NO), the CPU 61 continues driving the cutter motor 310 reversely and repeats S35. When the full-cutting blade 130 reached the first standby position (S35: YES), in S36, the CPU 61 stops the reverse driving of the full-cutting blade 130. Thereby, the cutter 10 shifts to the standby state, and the full-cutting action ends thereat. The CPU 61 ends the main process.

As described above, the distance D2 between the cam face 331 and the second arm 250 in the front-rear direction is smaller than the distance D1 between the cam face 331 and the first arm 140 in the front-rear direction. Therefore, the transmission rate to transmit the force from the cam 330 to the second arm 250 is greater than the transmission rate to transmit the force from the cam 330 to the first arm 140. Accordingly, the driving load on the cam 330 when the half-cutting action is performed in the half-cutting assembly 200 may be restrained from being intensified.

The half-cutting assembly 200 may cut the tape 8 halfway in the half-cutting action by moving the second arm 250 to rotate about the second shaft 19. Meanwhile, the full-cutting assembly 100 may cut the tape 8 fully in the full-cutting action by moving the first arm 140 to rotate about the first shaft 18 and moving the full-cutting blade 130 and the stationary blade 110 to overlap each other in the front-rear direction. In this arrangement, the driving load on the first arm 140 when performing the full-cutting action in the full-cutting assembly 100 is smaller than the driving load on the second arm 250 when performing the half-cutting action. Moreover, the transmission rate of the force from the cam 330 to the second arm 250 is greater than the transmission rate of the force from the cam 330 to the first arm 140. Therefore, the maximum driving load on the cam 330 may be restrained from increasing to be as large as the driving load on the cam 330 when, for example, the transmission rate from the cam 330 to the second cam 250 is smaller than the transmission rate from the cam 330 to the first arm 140. Accordingly, the cutting device 10 may restrain the maximum driving load on the cam 330 from increasing.

The cutting device 10 may cause the full-cutting assembly 100 to perform the full-cutting action or the half-cutting assembly 200 to perform the half-cutting action by controlling the cutter motor 31 to drive normally or reversely. Therefore, with the cutting device 10, a user may be released from a manual operation to use one of the full-cutting assembly 100 and the half-cutting assembly 200 selectively.

The CPU 61 may control the operations of the cutter motor 310 based on the amount of the current flowing through the cutter motor 310. Therefore, the force to press the protrusive part 231 against the supporting base 210 may be stabilized. In other words, the force to cut the tape 8 halfway in the half-cutting action by the half-cutting assembly 200 be reliably stabilized. In this regard, the cutting device 10 may be restrained from malfunctioning.

The rotation shaft 311 of the cutter motor 310 extends in the crosswise direction. Therefore, the cutting device 10 may be restrained from increasing in the size thereof in the vertical direction and the front-rear direction compared to, for example, a cutting device having a cutter motor with a rotation shaft that extends in a direction other than the crosswise direction.

The cutter motor 310 is located at the position to overlap the third shaft 340 in the vertical direction. Therefore, the cutting device 10 may be restrained from increasing in the size thereof in the crosswise direction and the front-rear direction compared to, for example, a cutting device, in which the cutter motor 310 is located at a position not overlapping the third shaft 340 in the vertical direction.

The stationary blade 110 extends upward from a position different from, or between, the crosswise ends of the fixing part 112. In this arrangement, strength of the stationary blade 110 may be improved compared to an arrangement, in which no fixing part is provided. While the full-cutting assembly 100 performs the full-cutting action, the stationary blade 110 may be subject to the force from the full-cutting blade 130 in the crosswise direction. Meanwhile, the fixing part 112 extending in the crosswise direction is fixed to the fixing frame 111. Therefore, while the force in the crosswise direction is applied to the stationary blade 110, the stationary blade 110 may be stably fixed to the fixing frame 11. Therefore, the cutting device 10 may perform the cull-cutting action through the full-cutting assembly 100 stably and reliably.

The pressing groove 335 may contact the second pin 251 of the second arm 250 directly. Therefore, the transmission rate from the cam 330 to the second arm 250 may be greater than a transmission rate in an arrangement such that the pressing groove 335 presses the second arm 250 indirectly, for example, through an intervening member such as a spring. In this arrangement, the cutting device 10 may restrain the driving load on the cam 330, when the half-cutting assembly 200 performs the half-cutting action, from increasing more effectively.

For example, the second pin 251 may be arranged on the cam face 331, and the second arm 250 may be formed to have the pressing groove 335. In such an arrangement, a space for an end of the second pin 251 to protrude on a rear side of the second arm 250 may be required. With the additional space between the second arm 250 and the first arm 140 in the front-rear direction, a volume of the cutting device 10 may increase in the front-rear direction. In contrast, in the cutting device 10, the pressing groove 335 is formed on the cam face 331, and the second pin 251 is arranged on the second arm 250. Therefore, compared to the arrangement, in which the second pin 251 is arranged on the cam face 331, and the pressing groove 335 is formed in the second arm 250, the cutting device 10 may be restrained from increasing in the size thereof in the front-rear direction.

The printer 1 has the cutting device 10 as described above. Therefore, the printer 1 may achieve the benefits achievable from the cutting device 10 as described above.

Although an example of carrying out the invention have been described, those skilled in the art will appreciate that there are numerous variations and permutations of the cutting device and the printer that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the cam 330 may not necessarily be driven by the cutter motor 310 to rotate, but the cam 330 may be coupled with an operating device and rotate by the user's manual operation through the operating device.

For another example, the second groove 333 and the second pin 251 may not necessarily be arranged on the cam face 331 and the second arm 250, respectively, but the second pin 251 and the second groove 333 may be arranged on the cam face 331 and the second arm 250, respectively. For another example, the first pin 332 and the first groove 141 may not necessarily be arranged on the cam face 331 and the first arm 140, respectively, but may be arranged on the first arm 140 and the cam face 331, respectively.

For another example, the cam 330 may not necessarily be coupled with the first arm 140 directly but may be coupled with the first arm 140 indirectly through an intervening member such as, for example, a spring. For another example, the cam 330 may not necessarily be coupled with the second arm 250 directly but may be coupled with the second arm 250 indirectly through an intervening member such as, for example, a spring.

For another example, the stationary blade 100 and the fixing part 112 may not necessarily together form the shape of T but may together form a shape of, for example, L. For another example, the fixing part 112 may be omitted, and the stationary blade 110 alone may be directly fixed to the fixing frame 11.

For another example, the cutter motor 310 may not necessarily be located at the position to overlap the third shaft 340 in the vertical direction but may be located at a position not overlapping the third shaft 340 in the vertical direction. For another example, the cutter motor 310 may be located at a position to overlap the third shaft 340 in the crosswise direction. In this arrangement, the cutting device 10 may be restrained from increasing in the size thereof in the vertical direction and in the front-rear direction. For another example, the cutter motor 310 may be located at a position to overlap the third shaft 340 in the front-rear direction. In this arrangement, the cutting device 10 may be restrained from increasing in the size thereof in the vertical direction and in the crosswise direction.

For another example, the rotation shaft 311 may not necessarily extend in the crosswise direction but may extend in a direction different from the crosswise direction. For example, the rotation shaft 311 may extend in the front-rear direction. In this arrangement, the cutting device 10 may be restrained from increasing in the size thereof in the vertical direction and in the crosswise direction. For another example, the rotation shaft 311 may extend in the vertical direction. In this arrangement, the cutting device 10 may be restrained from increasing in the size thereof in the front-rear direction and in the crosswise direction.

For another example, the full-cutting assembly 100 may not necessarily cut the tape 8 fully in the scissors fashion with the stationary blade 110. For example, the full-cutting assembly 100 may have a supporting base in place of the stationary blade 110, and the full-cutting blade 130 may press the tape 8 against the supporting base to cut the tape 8 fully in so-called the guillotine fashion.

For another example, the distance D2 between the cam face 331 and the second arm 250 may not necessarily be smaller than the distance D1 between the cam face 331 and the first arm 140 in the front-rear direction but may be equal to the distance D1 in the front-rear direction. For example, when the first arm 140 extending from the lower end of the full-cutting blade 130 bends frontward, the first arm 140 may be extended further frontward to the same position as the second arm 250 in the front-rear direction, and thereafter may bend again to extend leftward. In this arrangement, the distance D2 equal to the distance D1 may be reserved. In this arrangement, the benefits achievable from the cutting device 10 described earlier may be similarly achieved.

For another example, the fixing means 113, 114 may not necessarily be limited to the rod-and-hole engagement and the screws, but the fixing part 112 may be attached to the fixing frame 11 by, for example, welding or an adhesive agent.

For another example, in the main process (see FIGS. 12A-12B), after the half-cutting blade 240 reached the half-cutting position (S22: YES), the CPU 61 may not necessarily determine the level of the current flowing through the cutter motor 310 to control the cutter motor 310. In other words, S23 may be omitted. For example, the CPU 61 may, after determining that the half-cutting blade 240 reached the half-cutting position based on the signals from the first sensor 16 and the second sensor 17 (S22: YES), in S24, stop the reverse driving of the cutter motor 310.

For another example, the first shaft 18 and the second shaft 19 may not necessarily be arranged at the different positions but may be arranged coaxially. In this arrangement, the first shaft 18 and the second shaft 19 may be a single piece of shaft that may work commonly as the first shaft 18 and the second shaft 19. In this arrangement, a quantity of the parts in the cutting device 10 may be reduced. For another example, the third shaft 340 may be arranged coaxially with the first shaft 18 and/or the second shaft 19.

For another example, the cam 330, the second arm 250, and the first arm 140 may not necessarily be arranged in this order from front to rear along the front-rear direction. For example, the first arm 140 may be arranged on the rear side of the cam 330, and the second arm 250 may be arranged on the front side of the cam 330. According to this arrangement, cam faces may be formed on the rear side and the front side of the cam 330, and teeth to mesh with the gear 323 may be formed on a circumferential surface of the cam 330. Further, the first pin 332 may be arranged on the cam face on the rear side, and the second groove 333 may be formed on the cam face on the front side. The second pin 251 may extend rearward from the second arm 250. In this arrangement, the distance D1 may be a distance between the cam face on the rear side and the first arm 140 in the front-rear direction, and the distance D2 may be a distance between the cam face 331 and the second arm 250 in the front-rear direction.

For another example, the first arm 140 may not necessarily be formed integrally with the full-cutting blade 130 but may be formed separately from the full-cutting blade 130 and later coupled to the full-cutting blade 130. For another example, the second arm 250 may not necessarily be formed integrally with the holder 230 but may be formed separately from the holder 230 and later coupled to either the holder 230 or the half-cutting blade 240.

For another example, the full-cutting assembly 100 may not necessarily be in the arrangement such that the stationary blade 100 is fixed, and the full-cutting blade 130 is movable to approach or separate from the stationary blade 130, but the full-cutting assembly 100 may be in an arrangement such that both the full-cutting blade 130 and the stationary blade 100 are movable to approach or separate from each other. For another example, the half-cutting assembly 200 may not necessarily be in the arrangement such that the supporting base 210 is fixed, and the cutter section 270 is movable to approach or separate from the supporting base 210, but the half-cutting assembly 200 may be in an arrangement such that the cutter section 270 is fixed, and the supporting base 210 is movable to approach or separate from the cutter section 270. For another example, both the cutter section 270 and the supporting base 210 may be movable to approach or separate from each other.

For another example, the tape 8 may not necessarily consist of a plurality of layers but may consist of a single layer. For another example, the tape 8 may be in a tubular form. For another example, the controller 60 may or may not be located in the cutting device 10. For example, the controller 60 may be located in the printer 1 separately from the cutting device 10.

For another example, the protrusive part 231 may not necessarily be arranged in the holder 230 but may be arranged on the half-cutting blade 240. For another example, the protrusive part 231 may protrude from the supporting base 210 toward the cutter section 270. For another example, the protrusive part 231 may be arranged on each of the cutter section 270 and the supporting base 210. For another example, the protrusive part 231 may be arranged on the second arm 250. When the protrusive part 231 is arranged on the second arm 250, the protrusive part 231 may protrude, for example, downward from the lower end of the second arm 250 and may be arranged to contact an upper surface of the bottom frame 12, when the second arm 250 rotates clockwise in the rear view, before the edge 241 contacts the supporting base 214. In other words, the protrusive part 231 may be arranged to contact the upper surface of the bottom frame 12 when the half-cutting blade 240 is at the half-cutting position. In this arrangement, the clearance may be reserved between the placement area 215 on the supporting surface 214 and the edge 241.

What is claimed is:

1. A cutting device, comprising:

a full-cutting assembly, including a first cutting blade and a facing part that face each other in a first direction, the first cutting blade and the facing part extending in a second direction, the second direction intersecting with the first direction, the first cutting blade being coupled with a first arm, the first arm being rotatable about a first shaft extending in a third direction, the third direction intersecting with the first direction and the second direction, the full-cutting assembly being configured to cut a tape between the first cutting blade and the facing part fully through in a direction of thickness of the tape by moving the first arm to rotate about the first shaft;

a half-cutting assembly, including a second cutting blade and a supporting base that face each other in the first direction, the second cutting blade and the supporting base extending in the second direction, the second cutting blade being coupled with a second arm, the second arm being rotatable about a second shaft extending in the third direction, the half-cutting assembly being configured to cut the tape between the second cutting blade and the supporting base partly in the direction of thickness by moving the second arm to rotate about the second shaft; and a cam configured to rotate bidirectionally normally and reversely in directions opposite to each other about a third shaft, the third shaft extending in a third direction, the cam having a cam face, on which a first pressing part configured to press the first arm to rotate about the first shaft when the cam rotates normally and a second pressing part configured to press the second arm to rotate about the second shaft when the cam rotates reversely are arranged, wherein a distance between the cam face and the second arm in the third direction is smaller than or equal to a distance between the cam face and the first arm in the third direction.

2. The cutting device according to claim 1, wherein the facing part includes a blade, and wherein the full-cutting assembly is configured to cut the tape fully through in the direction of thickness by moving the first arm to rotate about the first shaft and causing the first cutting blade and the facing part to overlap each other in the third direction.

3. The cutting device according to claim 1, further comprising a motor configured to cause the cam to rotate normally and reversely.

4. The cutting device according to claim 3, further comprising a controller configured to control operations of the motor according to an amount of a current flowing through the motor.

5. The cutting device according to claim 3, wherein the motor includes a rotation shaft extending in the first direction.

6. The cutting device according to claim 3, wherein the motor is located at a position to overlap the third shaft in the second direction.

7. The cutting device according to claim 1, comprising:

a fixing part extending in the first direction; and a frame, to which the fixing part is fixed, wherein the facing part extends on one side of the fixing part in the second direction from a position different from either end of the facing part in the first direction.

8. The cutting device according to claim 1, wherein the second pressing part is configured to contact the second arm.

9. The cutting device according to claim 8, wherein the second pressing part includes a groove formed on the cam face; and wherein the second arm is provided with a pin extending in the third direction, the pin being inserted in the groove.

10. A printer, comprising:

a printing device configured to print an image on a tape;

a conveyer configured to convey the tape with the image printed thereon; and a cutting device, comprising:

a full-cutting assembly, including a first cutting blade and a facing part, the first cutting blade and the facing part being configured to face each other in a first direction across the tape conveyed to a position between the first cutting blade and the facing part by the conveyer, the first cutting blade and the facing part extending in a second direction, the second direction intersecting with the first direction, the first cutting blade being coupled with a first arm, the first arm being rotatable about a first shaft extending in a third direction, the third direction intersecting with the first direction and the second direction, the full-cutting assembly being configured to cut the tape at the position between the first cutting blade and the facing part fully through in a direction of thickness of the tape by moving the first arm to rotate about the first shaft;

a half-cutting assembly, including a second cutting blade and a supporting base, the second cutting blade and the supporting base being configured to face each other in the first direction across the tape conveyed to a position between the second cutting blade and the supporting base by the conveyer, the second cutting blade and the supporting base extending in the second direction, the second cutting blade being coupled with a second arm, the second arm being rotatable about a second shaft extending in the third direction, the half-cutting assembly being configured to cut the tape at the position between the second cutting blade and the supporting base partly in the direction of thickness by moving the second arm to rotate about the second shaft; and a cam configured to rotate bidirectionally normally and reversely in directions opposite to each other about a third shaft, the third shaft extending in a third direction, the cam having a cam face, on which a first pressing part configured to press the first arm to rotate about the first shaft when the cam rotates normally and a second pressing part configured to press the second arm to rotate about the second shaft when the cam rotates reversely are arranged, wherein a distance between the cam face and the second arm in the third direction is smaller than or equal to a distance between the cam face and the first arm in the third direction.

* * * * *